US009675132B2

(12) United States Patent
Marshall

(10) Patent No.: US 9,675,132 B2
(45) Date of Patent: Jun. 13, 2017

(54) SHOE WITH COLLAPSIBLE HEEL

(71) Applicant: Nike, Inc., Beaverton, OR (US)

(72) Inventor: Eric Joseph Marshall, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/834,518

(22) Filed: Aug. 25, 2015

(65) Prior Publication Data

US 2017/0055630 A1 Mar. 2, 2017

(51) Int. Cl.
*A43B 3/24* (2006.01)
*A43B 11/00* (2006.01)

(52) U.S. Cl.
CPC ..... *A43B 11/00* (2013.01); *A43B 3/24* (2013.01); *A43B 3/242* (2013.01); *A43B 3/248* (2013.01)

(58) Field of Classification Search
CPC A43B 3/24; A43B 3/248; A43B 11/00; A43B 17/16; A43B 23/088
USPC ..... 36/105, 138, 58.5
See application file for complete search history.

(56) References Cited

U.S. PATENT DOCUMENTS 1,686,175 A * 10/1928 Read ..... A43B 3/101 36/58.5
2,736,110 A * 2/1956 Hardimon ..... A43B 11/00 36/58.5
2,920,402 A * 1/1960 Minera ..... A43B 3/102 36/58.5
4,783,909 A * 11/1988 Van Doren ..... A43B 3/102 36/68
5,127,170 A * 7/1992 Messina ..... A43B 3/102 36/105
6,032,387 A 3/2000 Johnson
6,367,171 B1 * 4/2002 Burt ..... A43B 3/102 36/100
6,671,980 B1 1/2004 Liu et al.
6,922,917 B2 8/2005 Kerns et al.
7,059,069 B2 * 6/2006 Raluy ..... A43B 3/12 36/105
7,661,205 B2 2/2010 Johnson
7,793,438 B1 9/2010 Busse et al.
8,065,819 B2 11/2011 Kaufman
8,087,188 B2 1/2012 Labbe
D654,679 S * 2/2012 Dean ..... D2/969
8,225,535 B2 * 7/2012 Dillenbeck ..... A43B 3/242 36/100
2005/0022428 A1 2/2005 Anderson
2005/0039348 A1 * 2/2005 Raluy ..... A43B 3/12 36/50.1
2005/0076540 A1 * 4/2005 Su ..... A43B 11/00 36/105
2005/0198867 A1 9/2005 Labbe
2008/0189984 A1 * 8/2008 Januszewski ..... A43B 3/122 36/100

(Continued)

FOREIGN PATENT DOCUMENTS

WO 0235954 A1 5/2002

*Primary Examiner* — Marie Bays
(74) *Attorney, Agent, or Firm* — Wissing Miller LLP

(57) ABSTRACT

A shoe with collapsible heel, the shoe including an upper including a toe portion and an outer heel portion, and a heel control mechanism allowing the outer heel portion to be moved between a collapsed position and a plurality of heel embracing positions.

16 Claims, 7 Drawing Sheets

(56) References Cited

U.S. PATENT DOCUMENTS

2011/0016751 A1* 1/2011 Somerville ..... A43B 3/122
36/105

* cited by examiner

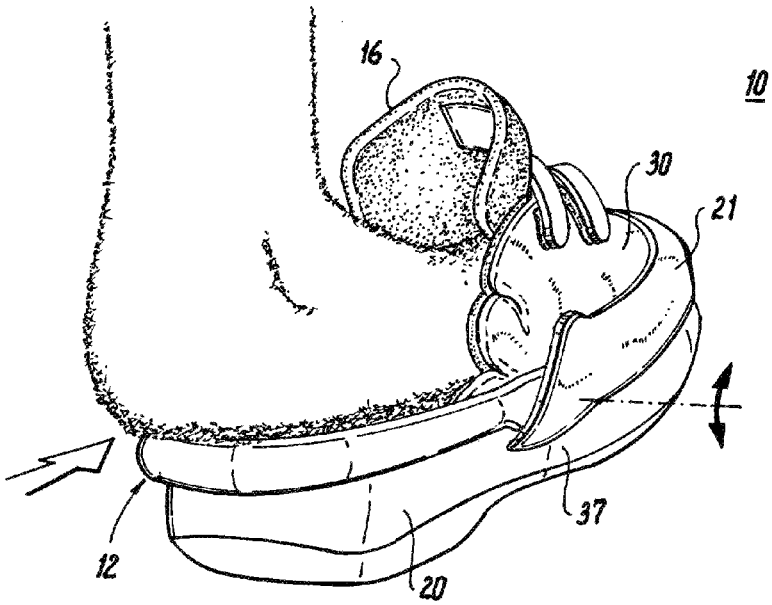
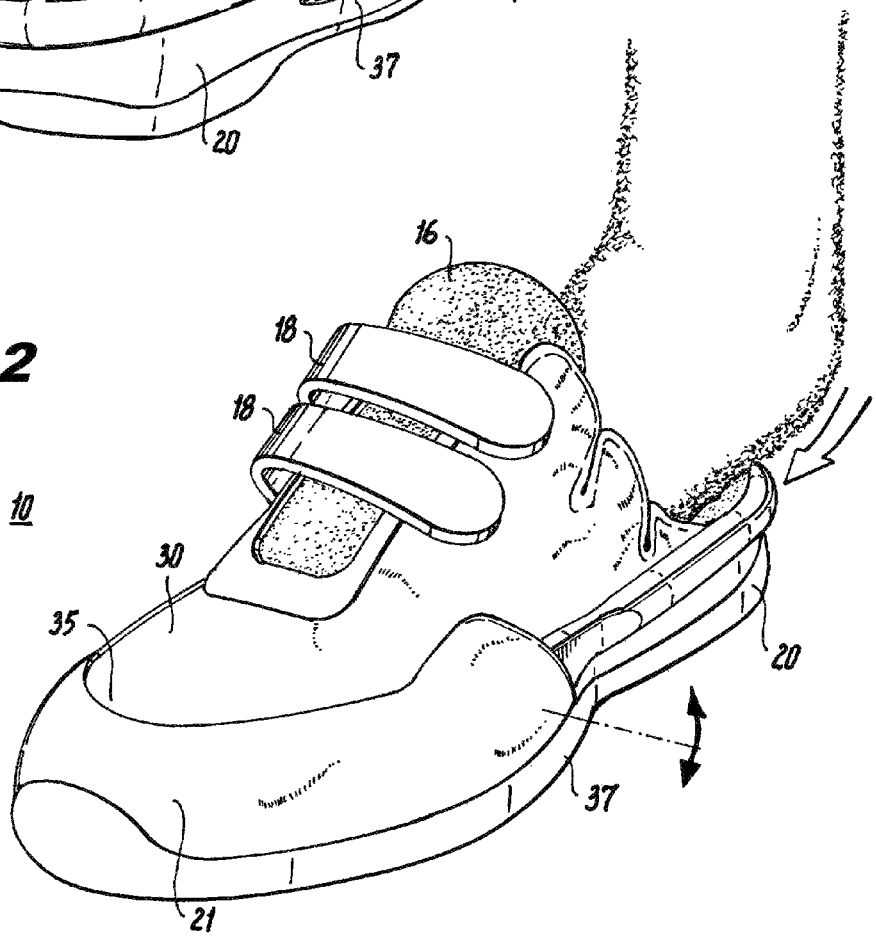
Fig. 2

10
16
100
18
18
12
32
21
120
110
110
44
120
110
110
4
20

SHOE WITH COLLAPSIBLE HEEL

BACKGROUND

Technical Field

The present disclosure relates generally to shoes and, more particularly, to shoes with collapsible heels.

Description of the Background Art

A variety of different types of shoes have been designed to suit the different lifestyles and activities of people. Such shoes include flip-flops, sandals, mules, slides, clogs, athletic shoes, dress and casual shoes, boots, and even specialty shoes like soccer shoes, bicycling shoes, and dance shoes. Slip-on shoes such as clogs, mules and flip-flops are designed to be slipped on and off with ease and are particularly popular because they permit easy entry into the shoe without the need to widen a foot opening at the top of the shoe and because they generally do not have a heel portion which may require the use of a shoe horn. Shoes for active use generally include a secure closure mechanism such as laces, straps, etc. along the top of the shoe and are used to secure a user's foot against the heel of the shoe so that the shoe does not slip off the foot during the chosen activity. For example, laces or straps extend across the foot opening and can be tightened by the user to secure the foot within the shoe. Slip-on footwear is generally not suitable for active use because such closure mechanisms and heels are absent.

The elderly and handicapped often have difficulty donning and/or doffing shoes. While slip-on shoes such as clogs, mules and flip-flops can be relatively easy for the elderly and handicapped to don and doff, these types of shoes can be dangerous for the elderly and handicapped because they lack heels and thus tend to more easily fall off of the user's foot creating a tripping hazard. Shoes having a heel can be particularly difficult for the elderly and handicapped to don or doff, often requiring the use of a shoe horn or the like. The elderly and handicapped often need assistance donning and doffing their shoes.

U.S. Pat. No. 2,736,110 discloses a shoe adapted for use by a handicapped person. The shoe has a relatively complex mechanism including arms and a yoke covered with flexible material forming the outer heel of the shoe. The arms and yoke are biased by a spring mechanism so that material forming the outer heel is normally extended in a heel embracing position. The shoe also includes a treadle in the base of the shoe below the user's heel. The treadle is biased by another spring in an upward direction. The treadle includes toothed members that engage lugs provided on the arms. Pressing down on the arms collapses the outer heel. When the user lifts their heel off of the treadle, the toothed members engage the lugs so that the outer heel is maintained in the down position. In this position, the user can insert their foot into the shoe. When the user lowers their heel and presses on the treadle, the toothed members disengage from the lugs and the outer heel springs up to the heel embracing position. While the disclosed mechanism may allow the shoe to be used by the handicapped, the complex mechanism is subject to failure. In addition, the mechanism requires a certain degree of coordination by the user since the outer heel must be pressed and held down while at the same time the user's heel is lifted from the treadle so that the toothed members surely engage the lugs to hold the outer heel in the down position. Furthermore, since the outer heel springs up to the heel embracing position, the outer heel can hit the user's heel with some force, possibly injuring the user.

Accordingly, what is needed is a shoe having a heel and which may be easily and securely donned and doffed by the user with minimum effort. The shoe should have a relatively simple mechanism for moving the outer heel into the lower position where the user can easily insert their foot into the shoe and for gently moving the outer heel into the raised heel embracing position.

SUMMARY

A shoe with collapsible heel, the shoe comprising an upper including a toe portion and an outer heel portion, a sole attached to a lower portion of the upper and a heel control mechanism allowing the outer heel portion to be moved between a collapsed position and a plurality of heel embracing positions.

A shoe with collapsible outer heel, the shoe comprising an outer heel pivotally attached at a side portion of the shoe and a heel control mechanism allowing the outer heel to move in a ratchet like manner in at least one of the clockwise and counter clockwise directions, wherein the outer heel portion is movable between a collapsed position and a fully extended heel embracing position.

A shoe with collapsible outer heel, the shoe comprising an upper including a toe portion and an outer heel portion and a heel control mechanism allowing the outer heel portion to be moved between a collapsed position and a fully extended heel embracing position, wherein the outer heel portion is at least one of freely movable and movable in a ratchet like manner between the collapsed position and the fully extended heel embracing position.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein:

FIG. 1 is a rear side view of a shoe according to an embodiment of the present disclosure with the outer heel in the collapsed position;

FIG. 2 is a front side view of a shoe according to an embodiment of the present disclosure with the outer heel in the collapsed position;

DETAILED DESCRIPTION

Figure 3:
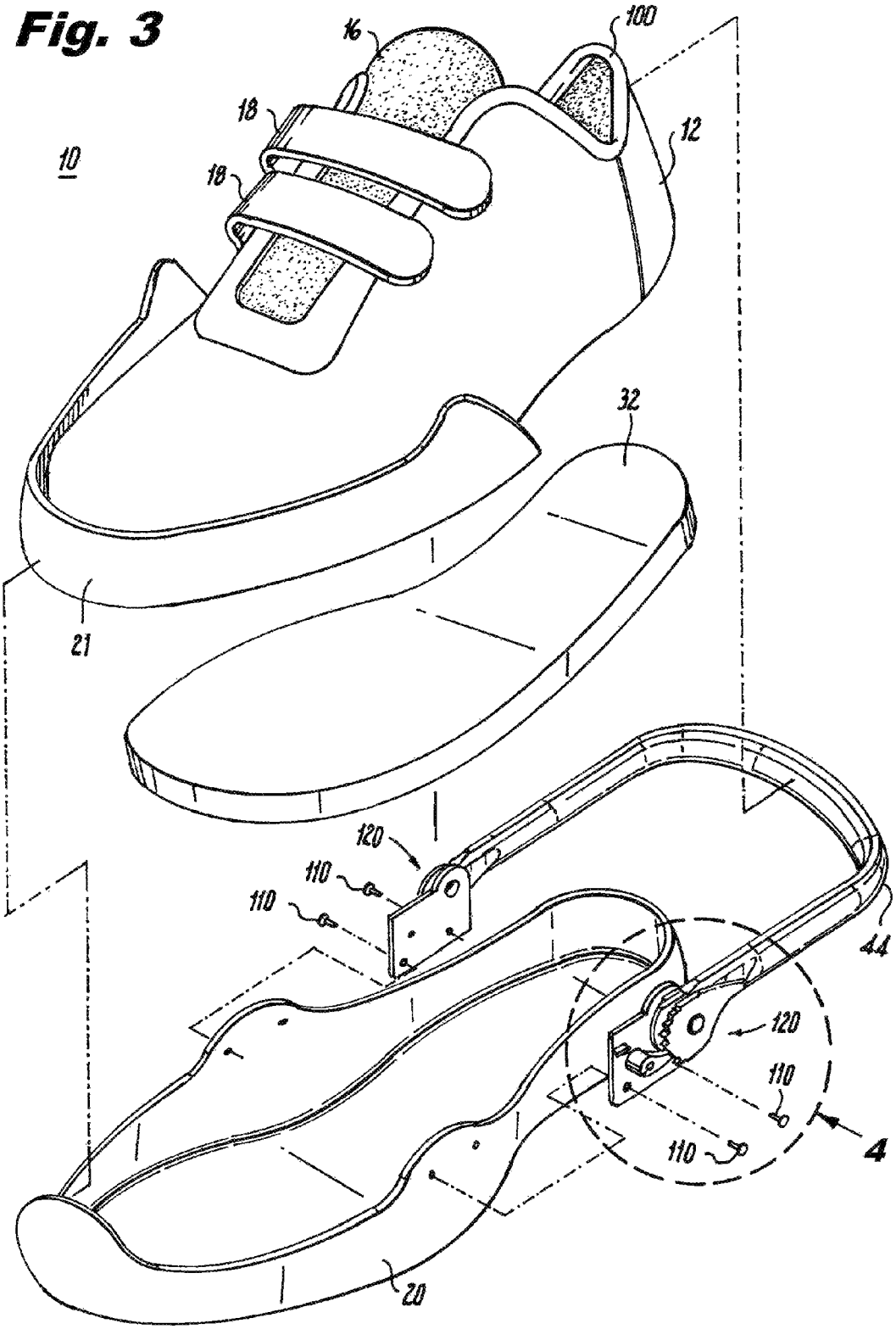
FIG. 3 is an exploded view of a shoe according to an embodiment of the present disclosure.

The following exemplary embodiments are set forth to aid in an understanding of the subject matter of this disclosure, but are not intended, and may not be construed, to limit in any way the claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

The term "shoe" as recited in the present disclosure is used in the generic sense to identify any type of footwear that can be worn on a user's foot. For example, the term "shoe" as used herein includes, but is not limited to, casual footwear, formal footwear, dress footwear, work footwear, athletic footwear, etc.

A shoe 10 according to an embodiment of the present disclosure is shown in FIGS. 1 and 2. Shoe 10 includes upper 30 and sole 20. Shoe 10 may also include a rubber toe cover 21 that wraps around the toe box portion 35 of shoe 10 as shown. Upper 30 may be formed from one or more sections of material and may include eyelets, a tongue, quarters, cuffs, etc. The material forming the upper may be leather, cloth, plastic, rubber, synthetic fabric such as nylon, etc. or any combination thereof and may include multiple layers of material as desired. According to this embodiment of the present disclosure, upper 30 includes a tongue 16 and straps 18. Straps 18 may be decorative and or elastic and permanently attached in the positions shown. In the alternative, the straps may be permanently attached on one side of the shoe and removably attached to the other side of the shoe using, for example, VELCRO®. Of course, depending on the type of shoe, other types of closures may be utilized including, for example, eyelets and laces, zippers, etc. In the alternative, upper 30 may be formed from one or more sections of material permanently closed at the top of the shoe. Generally speaking, shoe 10 includes toe box portion 35, midsole portion 37 and an outer heel (e.g., counter) portion 12.

Figure 6:
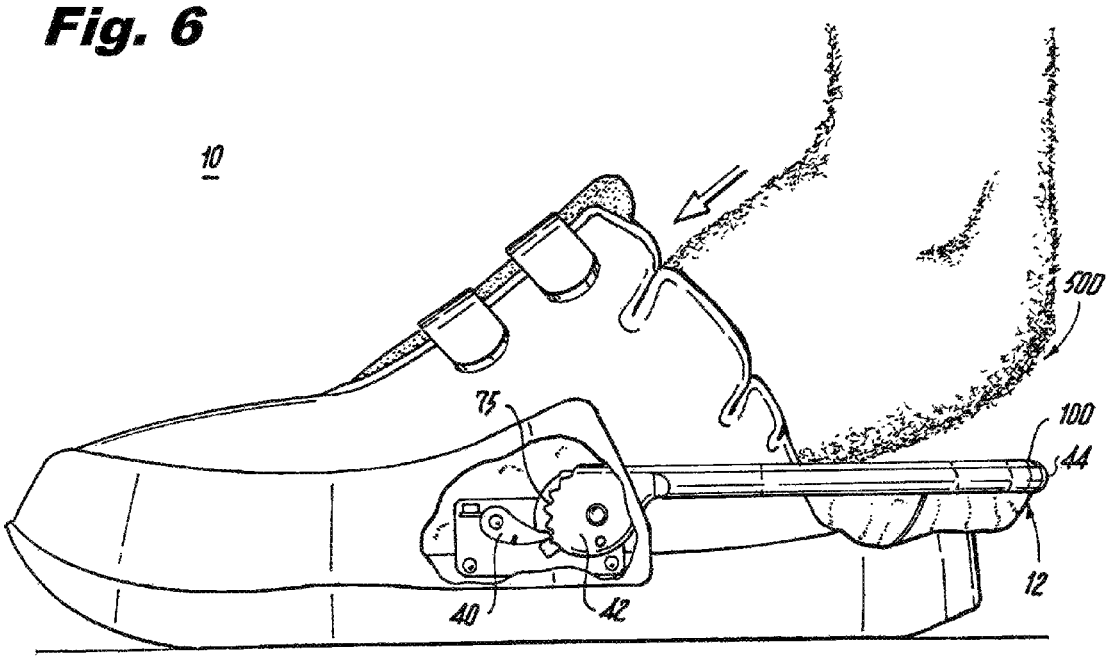
FIG. 6 is a side view of a shoe according to an embodiment of the present disclosure with the heel in collapsed position.
Figure 8:
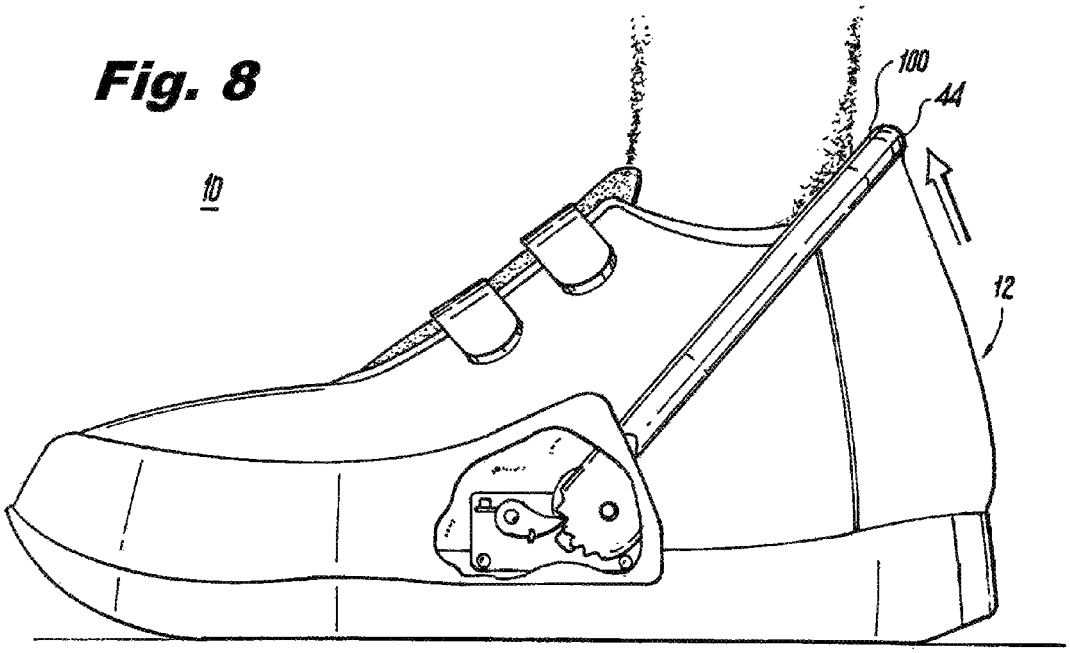
FIG. 8 is a side view of a shoe according to an embodiment of the present disclosure with the heel in the fully extended heel embracing position.

According to an embodiment of the present disclosure, outer heel portion 12 of shoe 10 is movable between the collapsed position shown in FIG. 6 and the extended position where the outer heel portion 12 embraces the user's heel as shown in FIG. 8. As will be described in more detail below, outer heel portion 10 can be easily moved between the extended position and collapsed position by the user utilizing their other foot. When the outer heel portion 12 is in the collapsed position shown in FIG. 6, a user can easily slip their foot 500 in or out of the shoe 10. To don shoe 2, when outer heel portion 12 is in the collapsed position as shown in FIG. 6, the user can easily insert their foot into the shoe 10 and then, using the toe of the user's other foot, the user can urge the outer heel portion 12 up to the extended position shown in FIG. 8 again embracing the user's heel.

A heel control mechanism according to an embodiment of the present disclosure for allowing the heel portion 12 of shoe 10 to be moved up and down is shown in FIG. 3. According to this embodiment of the present disclosure, the heel control mechanism includes ratchet mechanisms 120 mounted on the sides of the sole portions 20 of shoe 10 as shown. U-shaped bracket 44 is connected on each end to ratchet mechanisms 120. U-shaped bracket 44 is dimensioned to substantially follow the contour of outer heel portion 12 and is permanently attached to topline collar 100 of outer heel 12. For added padding and comfort, a padded inlay 32 may be provided above sole 20 as shown.

Figure 4:
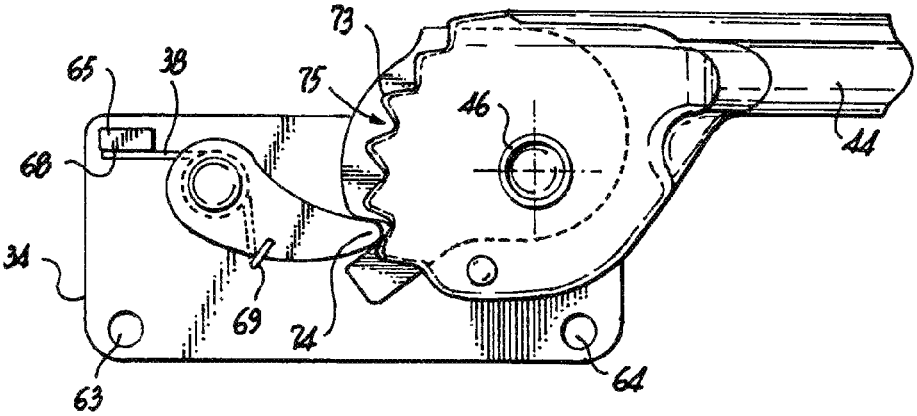
FIG. 4 is an enlarged view of a heel control mechanism according to an embodiment of the present disclosure.
Figure 5:
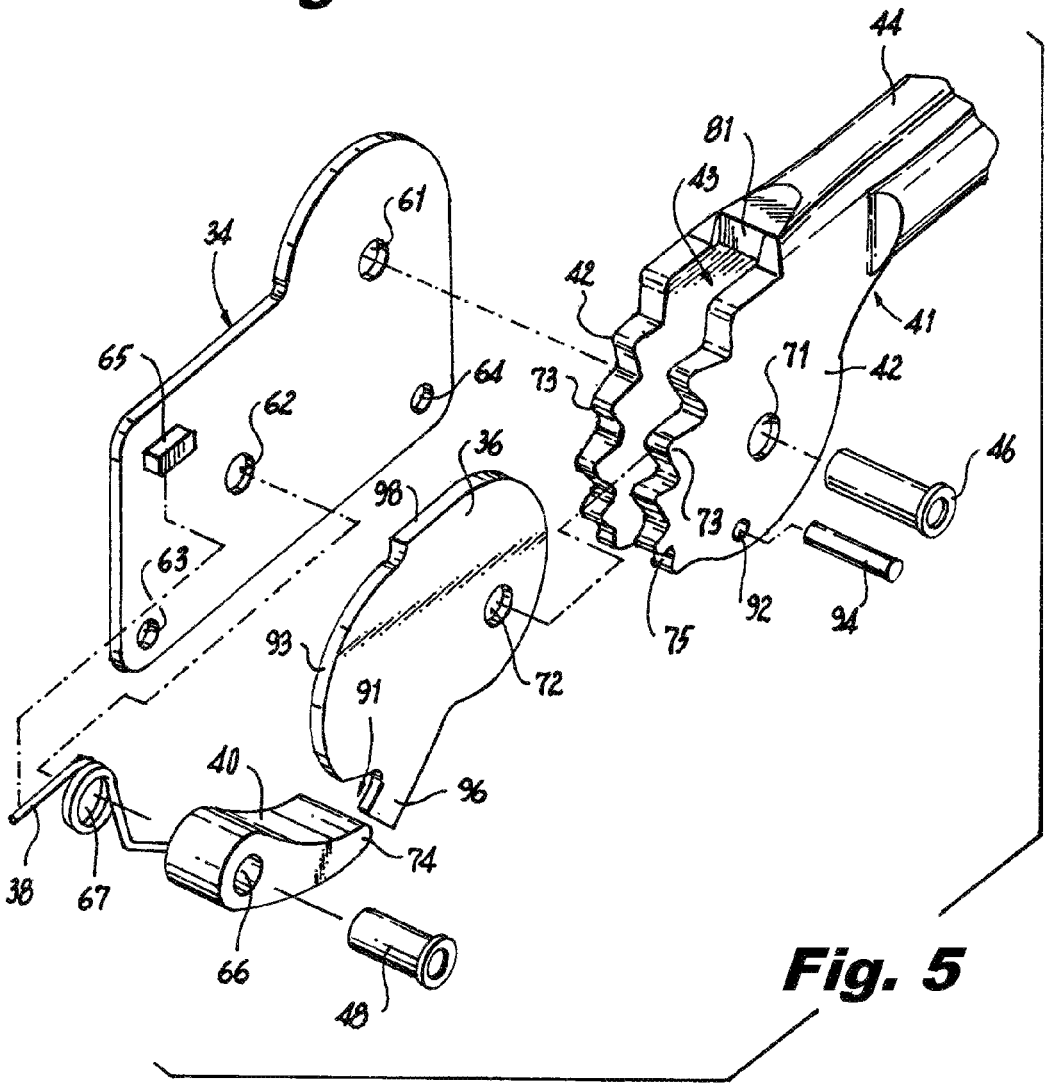
FIG. 5 is an exploded view of the heel control mechanism of FIG. 4 according to an embodiment of the present disclosure.

An example of a ratchet mechanism 120 according to an embodiment of the present disclosure is shown in more detail in FIGS. 4 and 5. Pin 48 extends through a hole 66 in pawl 40 and through a loop 67 formed by spring 38 and then through an orifice 62 provided in base plate 34. Pin 48 may be in the form of a rivet that is permanently press fit and/or welded into orifice 62. In the alternative, pin 48 may be threaded along with orifice 62 so that pin 48 may be screwed onto base plate 34. Pawl 40 is thus rotatable about pin 48. Distal end 68 of spring 38 extends into a raised notch 65 in base plate 34 for securing spring 38 in place. The proximal end 69 of spring 38 is bent in such a manner to engage the bottom edge of pawl 40. Spring 38 thus urges pawl 40 up in the counter clockwise direction. Ratchet bracket 41 is mounted to or formed from the same piece of material as a U-shaped bracket 44. Ratchet bracket 41 includes spaced matching ratchet bracket members 42 as shown. The upper portion of ratchet bracket 41 includes a catch 81 that engages and releases the ratchet mechanism so that the outer heel 12 can be easily collapsed as will be described later below. Ratchet bracket 41 further includes a reset pin 94 that is press fit into orifices 92 provided in ratchet bracket members 42 such that reset pin 94 spans the gap 43 between ratchet bracket members 42. Reset pin 94 engages and resets the ratchet mechanism as will also be described later below. Set/reset plate 36 is rotatably positioned in the gap 43 between ratchet bracket members 42. Set/reset plate 36 includes a reset arm 96 and a set surface 98. Pin 46 extends through holes 71 in ratchet bracket members 42, through a hole 72 in set/reset plate 36 and through orifice 61 provided in base plate 34. Pin 46 may be in the form of a rivet that is permanently press fit and/or welded into orifice 61. In the alternative, pin 46 may be threaded along with orifice 61 so that pin 46 may be screwed onto base plate 34. Set/reset plate 36 and ratchet brackets 42 are thus rotatably supported by pin 46. Ratchet bracket members 42 include one or more teeth 73 as shown. Pawl 40 is shaped and dimensioned such that distal end 74 of pawl 40 extends into the notches 75 between teeth 73. As will be described in more detail below, when the distal end 74 of pawl 40 is within gap 91 of set/reset plate 36, pawl is free to engage the notches 75 between teeth 73. Cam surface 93 of set/reset plate 36 is shaped and dimensioned to move pawl 40 out of gap 91 and away from teeth 73 so that the U-shaped bracket is free to rotate. Orifices 63, 64 are provided in base plate 34 so that base plate 34 can be mounted to the midsole portion 37 of shoe 10 using rivets, pins or screws 110 (see FIG. 3). A mirror image of mechanism 120 depicted in FIG. 4 may be provided on the opposite side of the shoe as shown in FIG. 3. The elements forming ratchet mechanism 120 may be formed of one or more suitable types of material, including metals, plastics, composites, etc.

Figure 7:
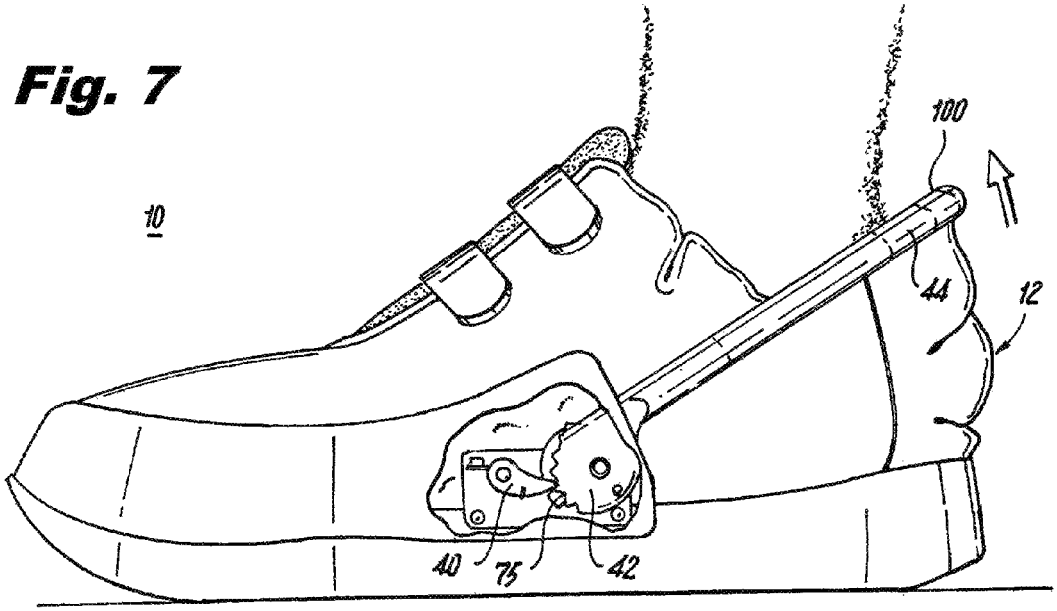
FIG. 7 is a side view of a shoe according to an embodiment of the present disclosure with the heel being moved from collapsed position to the fully extended position.

As shown in FIG. 6, with the outer heel 12 in the collapsed position, the user can easily insert their foot 500 into the shoe 10. Using the toe portion of their other foot or shoe, the user can urge U-shaped bracket 44 and topline collar 100 in the upward direction (FIG. 7) to the fully extended position as shown in FIG. 8. U-shaped bracket 44 and outer heel 12 move upward in a ratcheted manner. Referring to FIG. 7, for example, as pawl 40 enters each notch 75 in ratchet bracket member 42, the U-shaped bracket 44 and topline collar 100 are prevented from moving in the clockwise direction. In this way, should the user's toe slip off of the U-shaped bracket 44 while urging it in the upward direction, the outer heel portion 12 will not fully collapse. The user can then easily reengage the U-shaped bracket with their toe and continue urging the U-shaped bracket 44 in the upward direction. U-shaped bracket 44 is urged upward until pawl 40 engages the second to last notch in the U-shaped bracket 44 as shown in FIG. 8.

Figure 9:
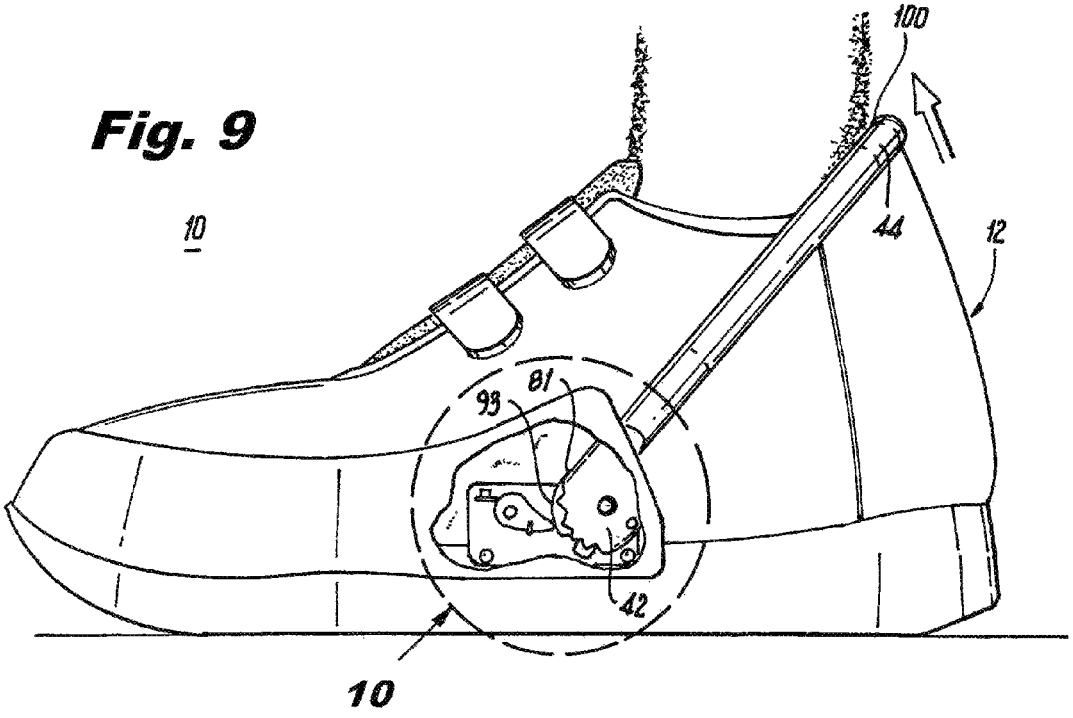
FIG. 9 is a side view of a shoe according to an embodiment of the present disclosure with the heel control mechanism in the disengaged position.
Figure 10:
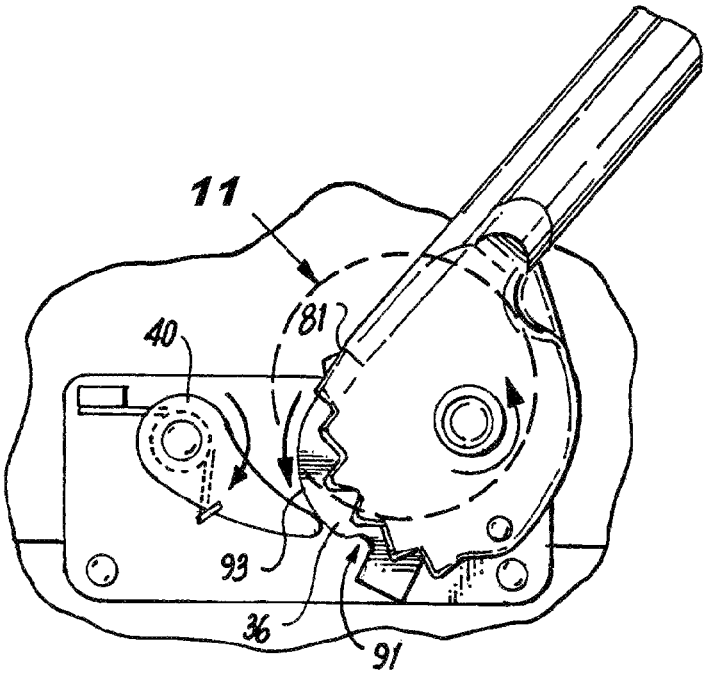
FIG. 10 shows an enlarged view of the heel control mechanism of FIG. 9 according to an embodiment of the present disclosure.
Figure 11:
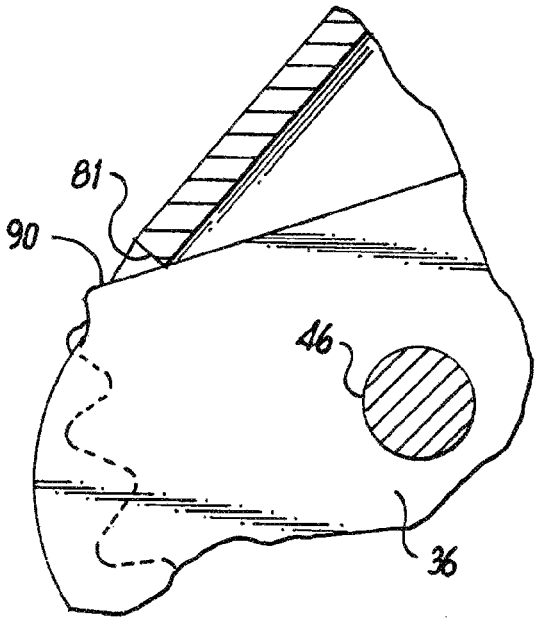
FIG. 11 is a further enlarged partial cutaway view of the heel control mechanism of FIG. 10 according to an embodiment of the present disclosure.
Figure 12:
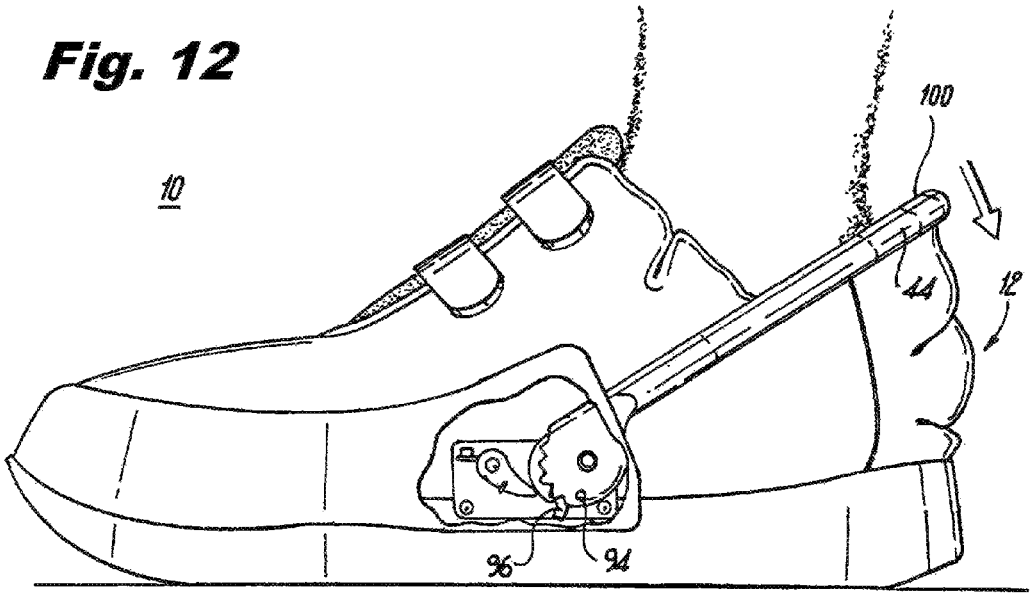
FIG. 12 is a side view of a shoe according to an embodiment of the present disclosure with heel being moved from the fully extended position to the collapsed position.
Figure 13:
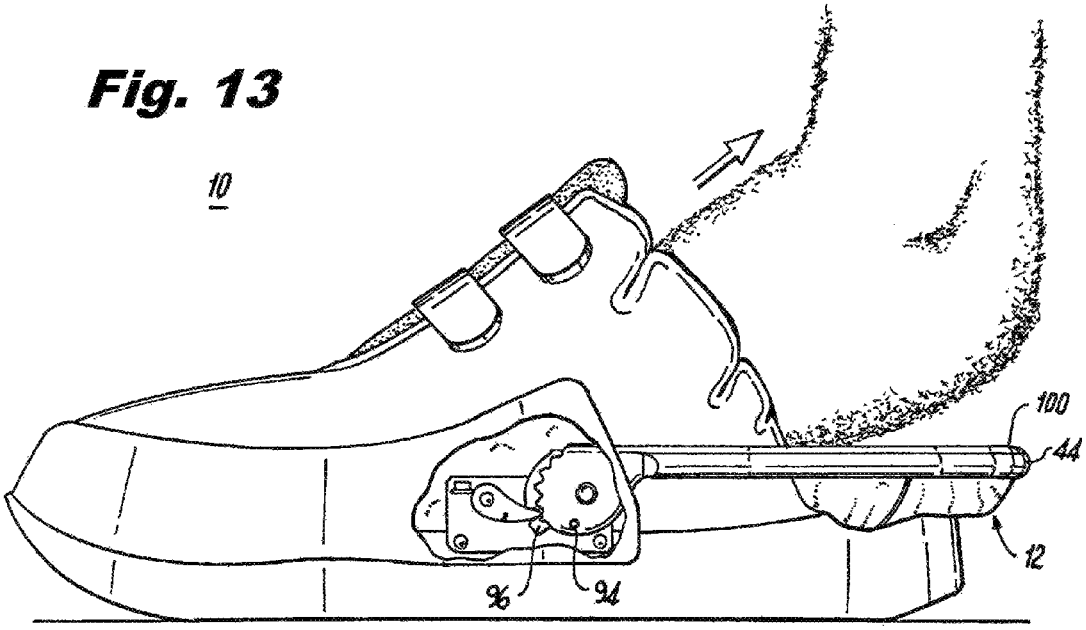
FIG. 13 is a side view of a shoe according to an embodiment of the present disclosure with the heel in the fully collapsed position.

To remove the user's foot from the shoe 12, the ratchet mechanism can be disengaged so that the outer heel portion 12 can be easily returned to the fully collapsed position. Using the toe of their other foot, the user urges U-shaped bracket 44 further in the upward or counter clockwise direction as shown in FIG. 9. As shown most clearly in FIGS. 10 and 11, this causes catch 81 of ratchet bracket 41 to engage the set surface 98 of set/reset plate 36 causing the set/reset plate 36 to rotate in the counter clockwise direction. Cam surface 93 of set/reset plate 36 causes pawl 40 to rotate in the clockwise direction away from the ratchet bracket 41 as shown in FIG. 10. When the pawl 40 is in the position shown in FIG. 10, U-shaped bracket 44 is free to move in the clockwise direction (see also FIG. 12) until the outer heel 12 is in the fully collapsed position shown in FIG. 13. Pawl 40 remains in position away from ratchet bracket 41 while outer heel portion 12 is being moved into the fully collapsed position until reset pin 94 engages reset arm 96 of set/reset plate 36. When reset pin 94 engages reset arm 96, set/reset plate 36 is moved in the clockwise direction until pawl reenters notch 91 in set/reset plate 36 thus resetting the ratchet mechanism.

U-shaped bracket 44 is shown on the outside of the shoe for ease of description. Of course, U-shaped bracket 44 may be hidden on the inside of the shoe and preferably between several layers of material forming upper 30 and outer heel portion 12. Mechanism 120 is shown in cutaway for ease of description. Of course, it will be appreciated that mechanism 120 can be sandwiched between two or more layers of material forming the upper 30.

The above-described embodiments include a ratchet mechanism provided on each side of the shoe. According to another embodiment of the present disclosure, only one ratchet mechanism is utilized and the other ratchet mechanism is replaced with a rotatably supported pivot plate. According to this embodiment, the U-shaped bracket extends between the ratchet mechanism on one side of the shoe to the rotatably supported pivot plate on the other side of the shoe. Operation of this alternative embodiment is similar to that described above.

The shoe with collapsible heel has been described in terms of particular embodiments. Of course, other embodiments are within the scope of the following claims.

Numerous additional modifications and variations of the present disclosure are possible in view of the above-teachings. It is therefore to be understood that within the scope of the appended claims, the present disclosure may be practiced other than as specifically described herein. For example, elements and/or features of different illustrative embodiments may be combined with each other and/or substituted for each other within the scope of this disclosure and appended claims.

What is claimed is:

1. A shoe with collapsible heel, the shoe comprising:

an upper including a toe portion and an outer heel portion; and a heel control mechanism allowing the outer heel portion to be moved between a collapsed position and a plurality of heel embracing positions, the heel control mechanism comprising:

a ratchet bracket member having a plurality of notches;

a ratchet bracket extending from the ratchet bracket member and attached to the outer heel portion of the shoe; and a pawl pivotally attached at a side portion of the shoe adjacent the ratchet bracket member, wherein the pawl is biased in a direction to engage the plurality of notches and prevent the ratchet bracket from moving in at least one of clockwise and counter clockwise directions.

2. The shoe as recited in claim 1, wherein the plurality of heel embracing positions comprise a fully extended heel embracing position and at least one partially extended position between the fully extended heel embracing position and the collapsed position.

3. The shoe as recited in claim 1, wherein the ratchet bracket comprises a U-shaped bracket.

4. The shoe as recited in claim 1, further comprising:

a sole attached to a lower portion of the upper; and a base plate attached to the sole, wherein the ratchet bracket member and pawl are pivotally attached to the base plate.

5. The shoe as recited in claim 1, further comprising a set/reset plate pivotally attached at the side portion of the shoe, the set/reset plate comprising a member that disengages the pawl from the plurality of notches of the ratchet bracket when the outer heel is extended beyond a fully extended heel embracing position.

6. The shoe as recited in claim 5, wherein when the pawl is disengaged from the plurality of notches, the outer heel is freely movable to the collapsed position.

7. The shoe as recited in claim 6, wherein the set/reset plate further comprises a notch that allows the pawl to engage one of the plurality of notches of the ratchet bracket when the outer heel is in the collapsed position.

8. A shoe with collapsible outer heel, the shoe comprising:

an outer heel pivotally attached at a side portion of the shoe and movable between a collapsed position and a fully extended heel embracing position; and a pawl and ratchet mechanism allowing the outer heel to pivot in one direction while preventing the outer heel from pivoting in an opposite direction.

9. The shoe as recited in claim 8, wherein when the pawl is disengaged from the ratchet the outer heel is freely movable from the fully extended heel embracing position to the collapsed position.

10. The shoe as recited in claim 8, further comprising a ratchet bracket attached to the outer heel and the pawl and ratchet mechanism.

11. The shoe as recited in claim 10, further comprising a set/reset plate engaging the ratchet bracket for selectively engaging and disengaging the pawl and ratchet mechanism such that the outer heel is freely movable from the fully extended heel embracing position to the collapsed position when the pawl is disengaged from the ratchet.

12. A shoe with collapsible outer heel, the shoe comprising:

an upper including a toe portion and an outer heel portion;

a ratchet mechanism pivotally attached at a side portion of the shoe allowing the outer heel portion to be moved between a collapsed position and a fully extended heel embracing position, and having a ratchet bracket extending therefrom and attached to the outer heel portion of the shoe; and a pawl pivotally attached at the side portion of the shoe adjacent the ratchet mechanism, wherein the pawl is biased in a direction to engage the ratchet mechanism to prevent the ratchet bracket from moving in at least one of clockwise and counter clockwise directions.

13. The shoe as recited in claim 12, wherein the outer heel portion is freely movable from the fully extended heel embracing position to the collapsed position.

14. The shoe as recited in claim 12, wherein the outer heel portion is movable in one direction while prevented from moving in an opposite direction as the outer heel portion is moved from the collapsed position to the fully extended heel embracing position.

15. The shoe as recited in claim 12, wherein the outer heel portion is movable in one direction while prevented from moving in an opposite direction as the outer heel portion is moved through a plurality of partially extended heel embracing positions as the outer heel portion is moved between the collapsed position and the fully extended heel embracing position.

16. The shoe as recited in claim 10, wherein the ratchet bracket is a U-shaped member.

* * * * *